US008143989B2

(12) United States Patent
Kumagai

(10) Patent No.: US 8,143,989 B2
(45) Date of Patent: Mar. 27, 2012

(54) MULTILAYER INDUCTOR

(75) Inventor: Akinobu Kumagai, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 13/192,274

(22) Filed: Jul. 27, 2011

(65) Prior Publication Data

US 2011/0285495 A1 Nov. 24, 2011

Related U.S. Application Data

(63) Continuation of application No. PCT/JP2010/050548, filed on Jan. 19, 2010.

(30) Foreign Application Priority Data

Feb. 2, 2009 (JP) ..... 2009-021637

(51) Int. Cl.
*H01F 5/00* (2006.01)

(52) U.S. Cl. ..... 336/200

(58) Field of Classification Search ..... 336/65, 336/83, 200, 206–208, 232
See application file for complete search history.

(56) References Cited

U.S. PATENT DOCUMENTS

| | | | | |
|---|---|---|---|---|
| 6,483,414 | B2 * | 11/2002 | Takeuchi et al. | 336/200 |
| 2011/0102123 | A1 * | 5/2011 | Hamano | 336/200 |
| 2011/0254650 | A1 * | 10/2011 | Banno | 336/200 |

FOREIGN PATENT DOCUMENTS

| | | | |
|---|---|---|---|
| JP | 11-186084 | A | 7/1999 |
| JP | 2003-272925 | A | 9/2003 |
| JP | 2005-056880 | A | 3/2005 |
| JP | 2005-340664 | A | 12/2005 |
| JP | 2006-066829 | A | 3/2006 |
| JP | 2008-130970 | A | 6/2008 |
| WO | 2008/018203 | A1 | 2/2008 |
| WO | 2010/016345 | A1 | 2/2010 |

OTHER PUBLICATIONS

International Search Report; PCT/JP2010/050548; Apr. 27, 2010.
Written Opinion of the International Searching Authority; PCT/JP2010/050548; Apr. 27, 2010.

* cited by examiner

*Primary Examiner* — Tuyen Nguyen
(74) *Attorney, Agent, or Firm* — Studebaker & Brackett PC; Tim L. Brackett, Jr.; John F. Guay

(57) ABSTRACT

This disclosure provides a multilayer inductor that has a built-in coil composed of coil conductors each having a length of one turn and that can suppress the occurrence of delamination. The inductor includes plural laminated magnetic layers. Coil conductors loop along a ring-shaped path each through a length of one-turn on the magnetic layers, and include connection portions including end portions that are located on the loop and connection portions including end portions that are located inside the ring-shaped path. Lands are provided on the insulating layers so as to overlap a region as viewed in plan, and the region is surrounded by the first connection portions and the second connection portions.

16 Claims, 5 Drawing Sheets

MULTILAYER INDUCTOR

CROSS REFERENCE TO RELATED APPLICATIONS

The present application claims priority to International Patent Application No. PCT/JP2010/050548 filed Jan. 19, 2010, and Japanese Patent Application No. 2009-021637 filed Feb. 2, 2009, the entire contents of each of these applications being incorporated herein by reference in their entirety.

FIELD OF THE INVENTION

The present invention relates to a multilayer inductor, and in particular, to a multilayer inductor having a built-in coil.

BACKGROUND

An example of a known multilayer inductor is described in Japanese Unexamined Patent Application Publication No. 2008-130970 (PTL 1). The multilayer inductor described in PTL 1 will now be described with reference to FIGS. 4 and 5 of the drawings.

FIG. 4 is an exploded perspective view of a laminate 111 of the multilayer inductor described in PTL 1. The laminate 111 includes magnetic layers 112*a* to 112*l*, inner conductors 114*a* to 114*f*, and via hole conductors B1 to B5. The magnetic layers 112*a* to 112*l* are insulating layers that are arranged in this order from the top to the bottom in the laminating, or stacking direction.

The inner conductor 114*a* is disposed on the magnetic layer 112*d* and one end thereof is drawn out to the right side of the laminate 111. The inner conductors 114*b* to 114*e* each loop through a length of one turn on the magnetic layers 112*e* to 112*h*, respectively. The inner conductors 114*b* to 114*e* respectively have connection portions 116*b* to 116*e* at one end thereof and connection portions 117*b* to 117*e* at the other end thereof. The inner conductors 114*b* and 114*d* have the same shape, and the inner conductors 114*c* and 114*e* have the same shape. The inner conductor 114*f* is disposed on the magnetic layer 112*i* and one end thereof is drawn out to the left side of the laminate 111.

The via hole conductors B1 to B5 connect pairs of the inner conductors 114*a* to 114*f* that are adjacent to each other in the laminating direction. Thus, a coil L that is spirally wound is formed in the laminate 111.

SUMMARY

The present disclosure provides a multilayer inductor including a built-in coil composed of coil conductors each having a length of one turn, and having a structure that can suppress delamination of the multilayer inductor.

In an embodiment of the present disclosure, a multilayer inductor includes a laminate including a plurality of insulating layers that are laminated. Each of a plurality of coil conductors loops along a ring-shaped path through a length of one-turn on the insulating layer in plan view as seen from a laminating direction. Each of the plurality of coil conductors includes a first connection portion including a first connection position that is on the ring-shaped path and a second connection portion including a second connection position that is not on the ring-shaped path. A first via hole conductor is between each adjacent pair of the first connection positions in the laminating direction to interconnect the first connection positions. A second via hole conductor is between each adjacent pair of second connection positions in the laminating direction to interconnect the second connection positions. At least one land is on a respective one of the insulating layers so as to overlap a predetermined region in plan view as seen from the laminating direction, the predetermined region being surrounded by the first connection portions and the second connection portions of the plurality of coil conductors.

Other features, elements, characteristics and advantages will become more apparent from the following detailed description with reference to the attached drawings.

DETAILED DESCRIPTION

Figure 4:
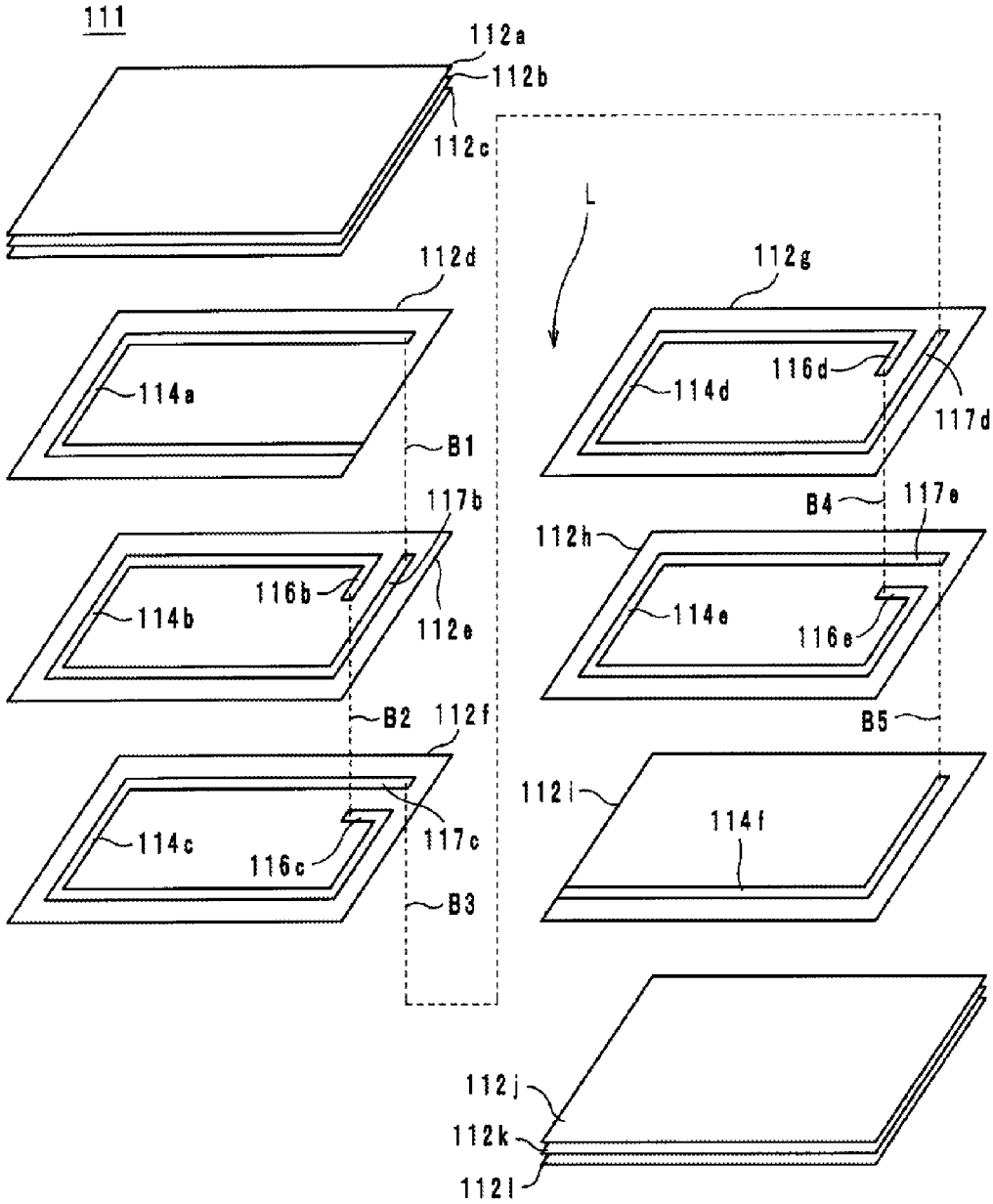
FIG.4 Prior Art
FIG. 4 is an exploded perspective view of a laminate of a multilayer inductor described in PTL 1.
Figure 5:
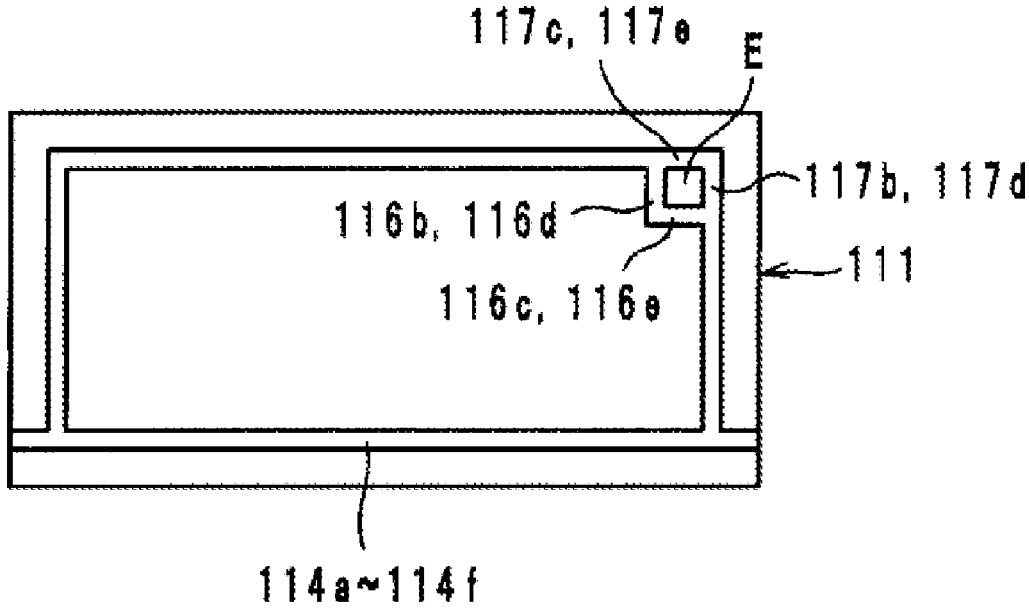
FIG.5 Prior Art
FIG. 5 is a transparent view of the laminate of FIG. 4 as seen from above in the laminating direction.

The inventor realized that multilayer inductor described in PTL 1 has a problem in that delamination easily occurs, as will be described below. FIG. 5 is a transparent view of the laminate 111 of FIG. 4 as seen from above in the laminating direction. The inner conductors 114*a* to 114*f* overlap in FIG. 5.

As illustrated in FIG. 5, the laminate 111 has a quadrangular region E that is surrounded by the connection portions 116*b* to 116*e* and 117*b* to 117*e*. The inner conductors 114*a* to 114*f* are not provided in the region E. As a result, the thickness of the laminate 111 in the region E in the laminating direction is smaller than the thickness, in the laminating direction, of the laminate 111 in a region (in which the connection portions 116*b* to 116*e* and 117*b* to 117*e* are provided) surrounding the region E by the amount of the thicknesses of the connection portions 116*b* to 116*e* and 117*b* to 117*e*. Therefore, when press-bonding the laminate 111, a tool for press-bonding cannot contact the region E and the region E may not be sufficiently pressed. Thus, delamination easily occurs in the region E of the multilayer inductor described in PTL 1.

Hereinafter, a multilayer inductor according to an exemplary embodiment that can address the delamination problem described above will now be described.

Figure 1:
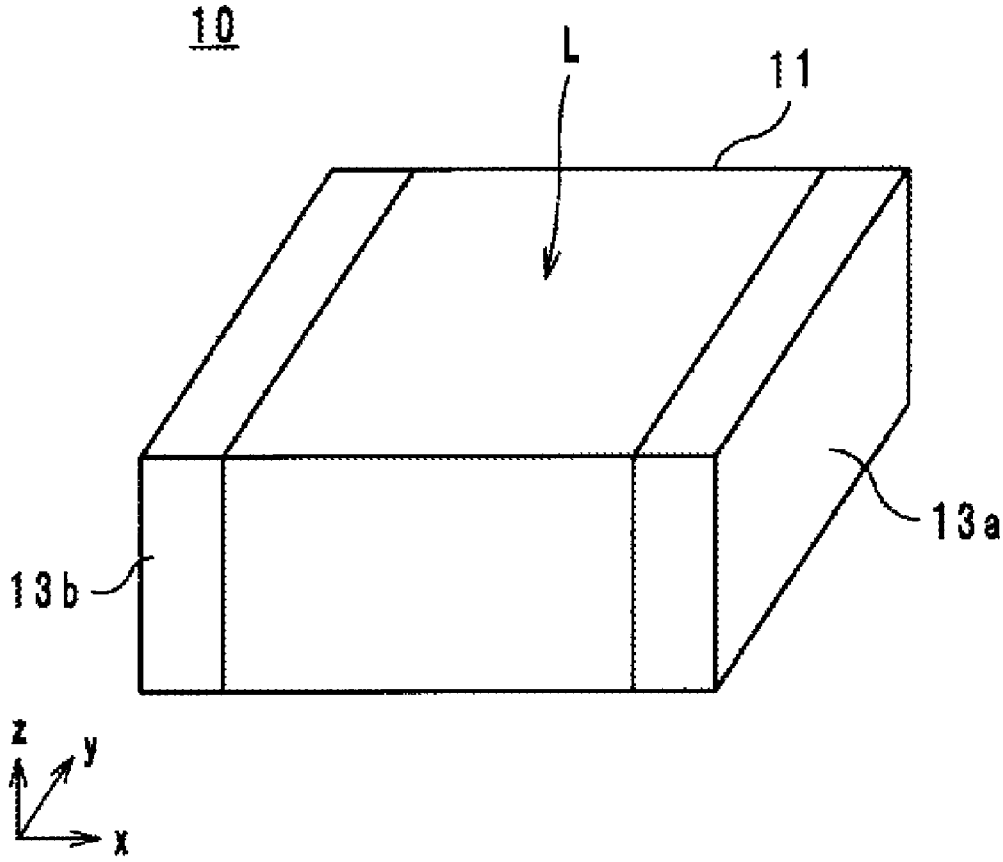
FIG. 1 is an external perspective view of a multilayer inductor according to an exemplary embodiment.
Figure 2:
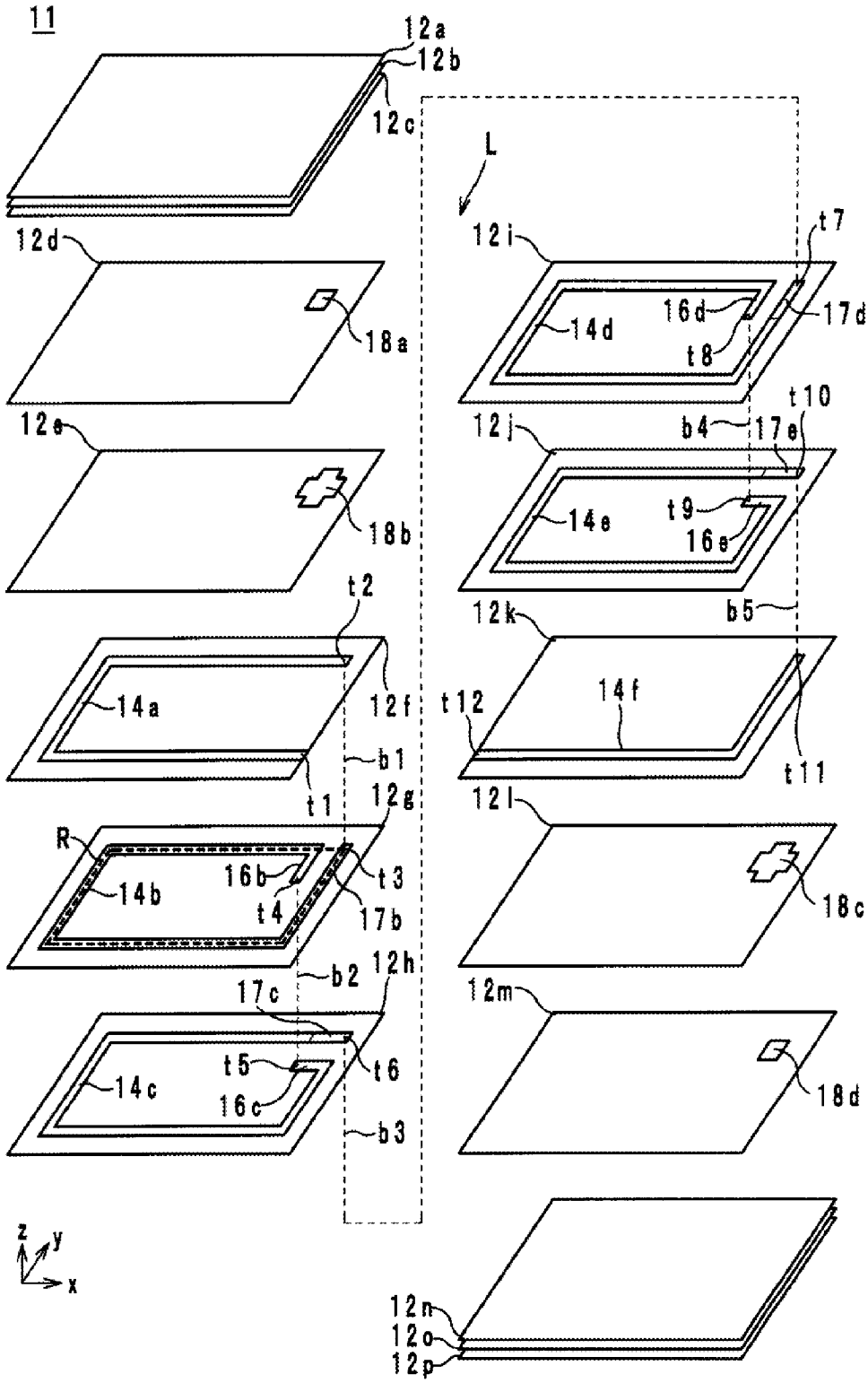
FIG. 2 is an exploded perspective view of a laminate of the multilayer inductor of FIG. 1.

FIG. 1 is an external perspective view of an exemplary multilayer inductor 10. FIG. 2 is an exploded perspective view of a laminate 11 of the multilayer inductor 10. Hereinafter, the laminating, or stacking direction of the multilayer inductor 10 is defined as the z-axis direction, a direction extending along a long side of the multilayer inductor 10 is defined as the x-axis direction, and a direction extending along a short side of the multilayer inductor 10 is defined as the y-axis direction.

As illustrated in FIG. 1, the multilayer inductor 10 includes the laminate 11 and external electrodes 13*a* and 13*b*. The laminate 11 is rectangular-parallelepiped-shaped. The external electrodes 13*a* and 13*b* are disposed, or provided on the side surfaces of the laminate 11 at ends in the x-axis direction.

As illustrated in FIG. 2, the laminate 11 includes magnetic layers 12*a* to 12*p*, coil conductors 14*a* to 14*f*, and lands 18*a* to 18*d*, which are laminated. The laminate 11 includes a coil L built therein and having a spiral shape. The magnetic layers

12*a* to 12*p* are rectangular insulating layers that are composed of a magnetic ferrite (for example, Ni—Zn—Cu ferrite, Ni—Zn ferrite, or the like), although the insulating layers can have a shape other than rectangular (e.g., a square shape). Hereinafter, the magnetic layers 12*a* to 12*p* and the coil conductors 14*a* to 14*f* will be independently denoted by a reference numeral followed by a character, and collectively denoted only by a reference numeral.

The coil conductors 14*a* to 14*f* are electrically connected to each other in the laminate 11, and thereby constitute the coil L. The coil conductors 14*b* to 14*e* are each made of a conductive material composed of silver and loop through a length of one turn on the magnetic layers 12*f* to 12*j*, respectively, in plan view as seen from the z-axis direction. To be specific, the coil conductors 14*b* to 14*e* loop along a ring-shaped path R (see the magnetic layer 12*g* in FIG. 2) that is substantially rectangular. The coil conductors 14*b* to 14*e* have connection portions 16*b* to 16*e* and 17*b* to 17*e* at ends thereof. The connection portions 16*b* to 16*e* include end portions (connection positions) t4, t5, t8, and t9, which are not on the ring-shaped path R (i.e., positioned inside the region surrounded by the loop R in FIG. 2). The coil conductors 14*b* to 14*e* thus include the connection portions 16*b* to 16*e*, and the end portions t4, t5, t8, and t9 are located inside the rectangular ring-shaped path R and overlap each other in plan view as seen from the z-axis direction.

The connection portions 17*b* to 17*e* include end portions (connection positions) t3, t6, t7, and t10, which are disposed, or provided on the ring-shaped path R. The coil conductors 14*b* to 14*e* thus include the connection portions 17*b* to 17*e*, and the end portions t3, t6, t7, and t10 are located on the rectangular ring-shaped path R and overlap each other in plan view as seen from the z-axis direction. The coil conductors 14*b* and 14*d* have the same shape, and the coil conductors 14*c* and 14*e* have the same shape. That is, the coil conductors 14*b* to 14*e* include two types of coil conductors that are alternately arranged in the z-axis direction.

The coil conductor 14*a* is disposed (provided) on a side of the coil conductors 14*b* to 14*e* in the positive z-axis direction. The coil conductor 14*a* is electrically connected to the coil conductors 14*b* to 14*e*, and thereby forms a part of the coil L. The coil conductor 14*a* is made of a conductive material composed of silver and loops through a length of ¾ turns on the magnetic layer 12*f* in plan view as seen from the z-axis direction. As illustrated in FIG. 2, an end portion t1 of the coil conductor 14*a* is drawn out to a side of the magnetic layer 12*f* in the positive x-axis direction. Thus, the coil conductor 14*a* is connected to the external electrode 13*a* (see FIG. 1). On the other hand, an end portion t2 is located on the rectangular ring-shaped path R and overlaps the end portion t3 in plan view as seen from the z-axis direction.

The coil conductor 14*f* is provided on a side of the coil conductors 14*b* to 14*e* in the negative z-axis direction. The coil conductor 14*f* is electrically connected to the coil conductors 14*b* to 14*e*, and thereby forms a part of the coil L. The coil conductor 14*f* is made of a conductive material composed of silver and loops through a length of ½ turns on the magnetic layer 12*k* in plan view as seen from the z-axis direction. As illustrated in FIG. 2, an end portion t12 of the coil conductor 14*f* is drawn out to a side of the magnetic layer 12*k* in the negative x-axis direction. Thus, the coil conductor 14*f* is connected to the external electrode 13*b* (see FIG. 1). On the other hand, an end portion t11 is located on the rectangular ring-shaped path R and overlaps the end portion t10 in plan view as seen from the z-axis direction.

Figure 3A:
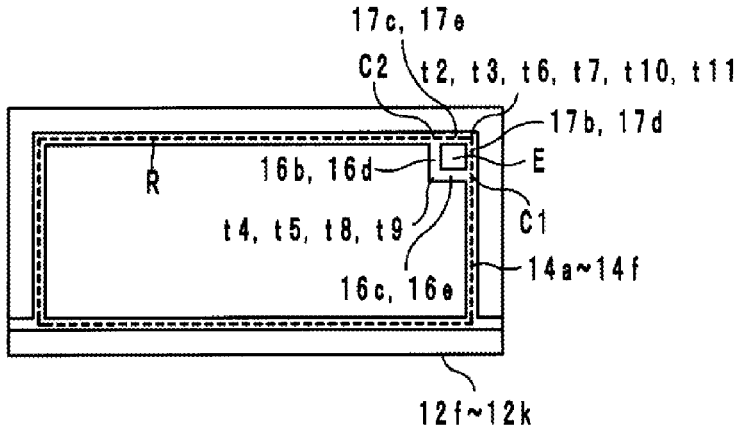
FIGS. 3A to 3C are plan views of magnetic layers 12 as seen from the positive z-axis direction side.
Figure 3B:
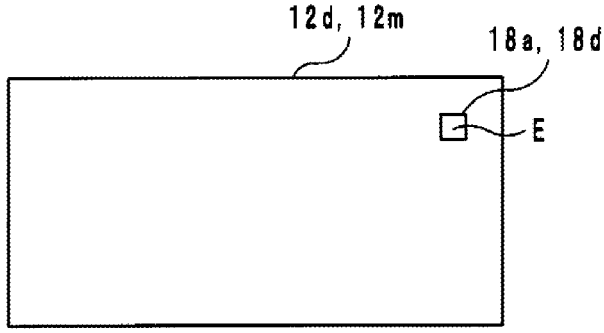
Figure 3C:
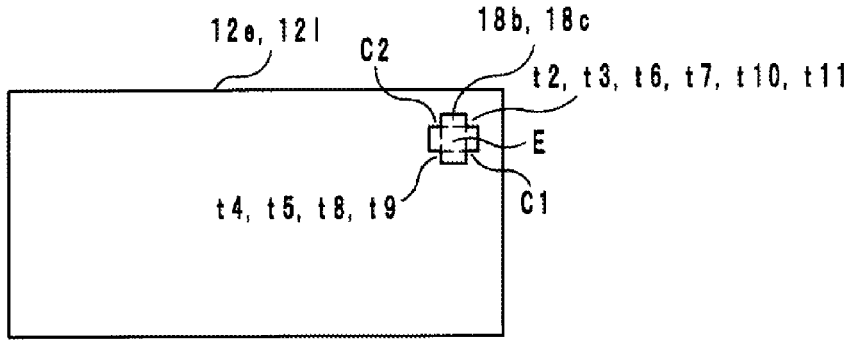

Next, the lands 18*a* to 18*d* will be described with reference to the drawings. FIGS. 3A to 3C are plan views of the magnetic layers 12 as seen from the positive z-axis direction side. FIG. 3A illustrates the magnetic layers 12*f* to 12*k*, which overlap each other. FIG. 3B illustrates the magnetic layers 12*d* and 12*m*. FIG. 3C illustrates the magnetic layers 12*e* and 12*l*.

The lands 18*a* and 18*b* are provided on a side of the coil conductors 14*a* to 14*f* in the positive z-axis direction. The lands 18*c* and 18*d* are disposed on a side of the coil conductors 14*a* to 14*f* in the negative z-axis direction. To be specific, as illustrated in FIGS. 3A and 3C, the lands 18*a* to 18*d* are disposed on the magnetic layers 12*d*, 12*e*, 12*l*, and 12*m*, respectively.

As illustrated in FIG. 3A, a quadrangular region E is formed in plan view as seen from the z-axis direction. The region E is surrounded by the connection portions 16*b* to 16*e* and the connection portions 17*b* to 17*e*, and the coil conductors 14*b* to 14*e* are not provided in the region E. The lands 18*a* to 18*d* are disposed on the magnetic layers 12*d*, 12*e*, 12*l*, and 12*m* so as to overlap the region E in plan view as seen from the positive z-axis direction side. To be specific, as illustrated in FIG. 3B, the lands 18*a* and 18*d* have the same shape as that of the region E and are disposed, or provided at positions corresponding to that of the region E. The lands 18*b* and 18*c* are provided so as to overlap the connection portions 16*b* to 16*e*, the connection portions 17*b* to 17*e*, and the region E in plan view as seen from the z-axis direction. However, the lands 18*b* and 18*c* do not overlap the end portions t2 to t11 in plan view as seen from the z-axis direction. The lands 18*b* and 18*c* do not overlap corners C1 and C2 in plan view as seen from the z-axis direction. The corners C1 and C2 are regions in which the connection portions 16*b* to 16*e* and the connection portions 17*b* to 17*e* overlap. Therefore, the lands 18*b* and 18*c* have a quadrangular shape from which the four corners thereof are cut off. The lands 18*a* to 18*d* are not electrically connected to the coil conductors 14.

The via hole conductors b1 to b5 electrically connect the coil conductors 14*a* to 14*f* to each other, and thereby form parts of the spiral coil L. More specifically, as illustrated in FIG. 2, the via hole conductor b1 is located on the ring-shaped path R and extends through the magnetic layer 12*f*, thereby connecting the end portion t2 and the end portion t3, which are adjacent to each other in the z-axis direction, to each other. The via hole conductor b2 is not located on the ring-shaped path R and extends through the magnetic layer 12*g*, thereby connecting the end portion t4 and the end portion t5, which are adjacent to each other in the z-axis direction, to each other. The via hole conductor b3 is located on the ring-shaped path R and extends through the magnetic layer 12*h*, thereby connecting the end portion t6 and the end portion t7, which are adjacent to each other in the z-axis direction, to each other. The via hole conductor b4 is not located on the ring-shaped path R and extends through the magnetic layer 12*i*, thereby connecting the end portion t8 and the end portion t9, which are adjacent to each other in the z-axis direction, to each other. The via hole conductor b5 is located on the ring-shaped path R and extends through the magnetic layer 12*j*, thereby connecting the end portion t10 to the end portion t11, which are adjacent to each other in the z-axis direction. That is, the via hole conductors b1, b3, and b5, which connect the end portions t2, t3, t6, t7, t10, and t11 that are on the ring-shaped path R, and the via hole conductors b2 and b4, which connect the end portions t4, t5, t8, and t9 that are not on the ring-shaped path R, are alternately arranged in the z-axis direction. Accordingly, the coil conductors 14 each having a length of one turn are connected to each other without causing shorts.

Referring to FIGS. 1 and 2, an exemplary method of making the multilayer inductor 10 will now be described.

First, ferric oxide ($Fe_2O_3$), zinc oxide (ZnO), nickel oxide (NiO), and copper oxide (CuO) are wet mixed in a predetermined ratio in a ball mill. Then, the resultant mixture is dried and crushed, and the resultant powder is calcined at 800° C. for one hour. The resultant calcined powder is wet ground in a ball mill, then is dried and disintegrated to obtain ferrite ceramic powder.

The ferrite ceramic powder is mixed with a binder (e.g., vinyl acetate, a water-soluble acrylic resin, or the like), a plasticizer, a wetting agent, and a dispersing agent in a ball mill, and then is defoamed by decreasing pressure. The resultant ceramic slurry is spread over a carrier sheet by using a doctor blade method and then dried, thereby making ceramic green sheets that will become the magnetic layers 12.

Next, the via hole conductors b1 to b5 are formed in the ceramic green sheets that will become the magnetic layers 12*f* to 12*j*, respectively. To be specific, via holes are formed in the ceramic green sheets that will become the magnetic layers 12*f* to 12*j* by irradiating the ceramic green sheets with laser beams. Then, the via holes are filled with a conductive paste, which is composed of silver, palladium, copper, gold, or an alloy of such metals, by using a method such as print coating.

Next, the coil conductors 14*a* to 14*f* are formed on the ceramic green sheets that will become the magnetic layers 12*f* to 12*k* by applying a conductive paste, which is composed of silver, palladium, copper, gold, or an alloy of such metals, by using a method such as screen printing or photolithography. The process of forming the coil conductors 14*a* to 14*f* and the process of filling the via holes with the conductive paste may be performed in the same process.

Next, the lands 18*a* to 18*d* are formed on the ceramic green sheets that will become the magnetic layers 12*d*, 12*e*, 12*l*, and 12*m* by applying a conductive paste, which is composed of silver, palladium, copper, gold, or an alloy of such metals, by using a method such as screen printing or photolithography.

Next, the ceramic green sheets are laminated. More specifically, a ceramic green sheet that will become the magnetic layer 12*p* is set in place. A carrier film is removed from a ceramic green sheet that will become the magnetic layer 12*o*, and the ceramic green sheet is placed on the ceramic green sheet that will become the magnetic layer 12*p*. Subsequently, the ceramic green sheet that will become the magnetic layer 12*o* is press-bonded to the magnetic layer 12*p*. The press-bonding is performed by applying a pressure in the range of 100 to 120 tons for about 3 to 30 seconds. The carrier film may be removed by suction or by chucking. Subsequently, ceramic green sheets that will become the magnetic layers 12*n*, 12*m*, 12*l*, 12*k*, 12*j*, 12*i*, 12*h*, 12*g*, 12*f*, 12*e*, 12*d*, 12*c*, 12*b*, and 12*a* are laminated and press-bonded in the same manner in this order. As a result, a mother laminate is formed. The mother laminate is subjected to permanent press-bonding by using an isostatic press or the like.

Next, the mother laminate is press-cut into the laminate 11 having a predetermined size. Thus, the laminate 11 that has not been fired is obtained. The unfired laminate 11 is subjected to debinding and firing. The debinding is performed, for example, in a low-oxygen atmosphere at 500° C. for two hours. The firing is performed, for example, at 890° C. for two and a half hours.

After the process described above, the laminate 11 that has been fired is obtained. The laminate 11 is subjected to barrel processing and is chamfered. Subsequently, silver electrodes that will become the external electrodes 13*a* and 13*b* are formed on the laminate 11 by applying a conductor paste composed of silver to the surface of the laminate 11 by using, for example, a dipping method or the like and then baking the conductor paste. Baking of the silver electrodes is performed at 800° C. for one hour.

Finally, the external electrodes 13*a* and 13*b* are formed on the silver electrodes by performing Ni plating or Sn plating on the silver electrodes. After the process described above, the multilayer inductor 10 illustrated in FIG. 1 is obtained.

The multilayer inductor 10, which has the structure described above, is capable of suppressing occurrence of delamination in the region E, although the multilayer inductor 10 has the built-in coil L, which is composed of the coil conductors 14 each having a length of one turn. More specifically, in the multilayer inductor described in PTL 1, the thickness of the laminate 111 in the region E in the laminating direction is smaller than the thickness, in the laminating direction, of the laminate 111 in a region surrounding the region E by the amount of the thicknesses of the connection portions 116*b* to 116*e* and 117*b* to 117*e*. Therefore, when press-bonding the laminate 111, a tool for press-bonding cannot contact the region E and the region E may not be sufficiently pressed. As a result, the multilayer inductor described in PTL 1 has a problem in that delamination easily occurs in the region E.

On the other hand, as illustrated in FIG. 2, the multilayer inductor 10 includes the lands 18*a* to 18*d*, which overlap the region E in plan view as seen from the z-axis direction. Thus, in the multilayer inductor 10, the difference between the thickness of the laminate 11 in the region E in the z-axis direction and the thickness, in the z-axis direction, of the laminate 11 in a region of surrounding the region E is small, as compared with the multilayer inductor described in PTL 1. Therefore, in the multilayer inductor 10, the lands 18*a* to 18*d* apply a pressure to the magnetic layers 12 in the region E, as compared with the multilayer inductor described in PTL 1. Moreover, before being fired, the land 18*a* to 18*d* have a hardness higher than that of the magnetic layers 12, whereby a pressure is more effectively applied to the magnetic layers 12 in the region E due to the presence of the land 18*a* to 18*d*. As a result, the magnetic layers 12 in the region E are strongly press-bonded in the multilayer inductor 10 as compared with the multilayer inductor described in PTL 1, whereby occurrence of delamination is suppressed.

In the multilayer inductor 10, the lands 18*b* and 18*c* are provided so as to overlap the connection portions 16*b* to 16*e* and 17*b* to 17*e* in plan view as seen from the z-axis direction. Therefore, occurrence of delamination is suppressed also at a position of the laminate 11 in which the connection portions 16*b* to 16*e* and 17*b* to 17*e* are provided.

The lands 18*b* and 18*c* have a quadrangular shape from which four corners thereof are cut off, so that the lands 18*b* and 18*c* do not overlap the end portions t2 to t11 in plan view as seen from the z-axis direction. Moreover, the lands 18*b* and 18*c* do not overlap the corners C1 and C2 in plan view as seen from the z-axis direction. The end portions t2 to t11 and the corners C1 and C2 are at positions that surround the region E and in which the connection portions 16*b* to 16*e* and 17*b* to 17*e* overlap. Therefore, the thickness of the laminate 11 at the end portions t2 to t11 and the corners C1 and C2 is larger than the thickness of the laminate 11 at positions surrounding the region E and excluding the end portions t2 to t11 and the corners C1 and C2. Accordingly, the lands 18*b* and 18*c* need not be provided in portions that overlap the end portions t2 to t11 and the corners C1 and C2.

A multilayer inductor according to the present invention is not limited to the multilayer inductor 10 according to the embodiment, and can be modified within the spirit and scope of the present invention. For example, the multilayer inductor

10 may include only the lands 18*b* and 18*c*, without including the lands 18*a* and 18*d*. Alternatively, the multilayer inductor 10 may include only the lands 18*a* and 18*d*, without including the lands 18*b* and 18*c*.

The lands 18*b* and 18*c* can have an area larger than that shown in FIG. 2. The lands 18*a* to 18*d* may be insulators.

In the multilayer inductor 10, the connection positions to which the via hole conductors b1 to b5 are connected are the end portions t2 to t11. However, the connection positions need not be the end portions t2 to t11 of the coil conductors 14.

The present invention is applicable to a multilayer inductor. In particular, the present invention has an advantage in that occurrence of delamination can be suppressed in a multilayer inductor having a built-in coil composed of coil conductors each having a length of one turn.

While exemplary embodiments have been described above, it is to be understood that variations and modifications will be apparent to those skilled in the art without departing from the scope and spirit of the disclosure. The scope of the invention, therefore, is to be determined solely by the following claims and their equivalents.

The invention claimed is:

1. A multilayer inductor comprising:

a laminate including a plurality of insulating layers that are laminated;

a plurality of coil conductors each of which loops along a ring-shaped path through a length of one-turn on the insulating layer in plan view as seen from a laminating direction, the plurality of coil conductors each including a first connection portion including a first connection position that is on the ring-shaped path and a second connection portion including a second connection position that is not on the ring-shaped path;

a first via hole conductor between each adjacent pair of first connection positions in the laminating direction to interconnect the first connection positions;

a second via hole conductor between each adjacent pair of second connection positions in the laminating direction to interconnect the second connection positions; and at least one land on a respective one of the insulating layers so as to overlap a predetermined region in plan view as seen from the laminating direction, the predetermined region being surrounded by the first connection portions and the second connection portions of the plurality of coil conductors.

2. The multilayer inductor according to claim 1, wherein the at least one land overlaps the first connection portions and the second connection portions in plan view as seen from the laminating direction.

3. The multilayer inductor according to claim 1, wherein the at least one land does not overlap the first connection positions and the second connection positions of the plurality of coil conductors in plan view as seen from the laminating direction.

4. The multilayer inductor according to claim 2, wherein another of at least one of the lands does not overlap the first connection positions and the second connection positions of the plurality of coil conductors in plan view as seen from the laminating direction.

5. The multilayer inductor according to claim 1, wherein the at least one land is provided below or above the plurality of coil conductors in the laminating direction.

6. The multilayer inductor according to claim 2, wherein the at least one land is provided below or above the plurality of coil conductors in the laminating direction.

7. The multilayer inductor according to claim 3, wherein the at least one land is provided below or above the plurality of coil conductors in the laminating direction.

8. The multilayer inductor according to claim 4, wherein each of the lands is provided below or above the plurality of coil conductors in the laminating direction.

9. The multilayer inductor according to claim 1, wherein the at least one land is not electrically connected to the coil conductors.

10. The multilayer inductor according to claim 2, wherein the at least one land is not electrically connected to the coil conductors.

11. The multilayer inductor according to claim 3, wherein the at least one land is not electrically connected to the coil conductors.

12. The multilayer inductor according to claim 4, wherein each of the lands is not electrically connected to the coil conductors.

13. The multilayer inductor according to claim 5, wherein the at least one land is not electrically connected to the coil conductors.

14. The multilayer inductor according to claim 6, wherein the at least one land is not electrically connected to the coil conductors.

15. The multilayer inductor according to claim 7, wherein the at least one land is not electrically connected to the coil conductors.

16. The multilayer inductor according to claim 8, wherein each of the lands is not electrically connected to the coil conductors.

* * * * *